United States Patent [19]

Schaffer et al.

[11] Patent Number: 5,042,553

[45] Date of Patent: Aug. 27, 1991

[54] WINDOW BLIND HEADRAIL AND MOUNTING BRACKET

[75] Inventors: John F. Schaffer, Corona del Mar; Sandra K. Young, Newport Beach; David C. Burns, San Francisco; Don S. Minami, Monte Sereno, all of Calif.

[73] Assignee: Levolor Corporation, Sunnyvale, Calif.

[21] Appl. No.: 498,247

[22] Filed: Mar. 14, 1990

[51] Int. Cl.[5] ..... E06B 9/30

[52] U.S. Cl. ..... 160/178.1; 160/902; 248/222.2; 248/251

[58] Field of Search ..... 160/168.1, 176.1, 902, 160/178.1, 166.1; 248/222.2, 251

[56] References Cited

U.S. PATENT DOCUMENTS

| | | | |
|---|---|---|---|
| 2,698,727 | 1/1955 | Rutledge | 160/902 X |
| 4,235,406 | 11/1980 | Vecchiarelli | 248/251 |
| 4,411,401 | 10/1983 | Anderson | 248/251 X |
| 4,607,818 | 8/1986 | Georgopoulos | 160/902 X |
| 4,719,955 | 1/1988 | Tachikawa et al. | 160/168.1 |
| 4,802,644 | 2/1989 | Oskam | 160/902 X |
| 4,878,528 | 11/1989 | Kobayashi | 160/168.1 |
| 4,938,443 | 7/1990 | Rowe | 160/178.1 X |

*Primary Examiner*—David M. Purol

*Attorney, Agent, or Firm*—Skjerven, Morrill, MacPherson, Franklin & Friel

[57] ABSTRACT

A window blind headrail mounting a Venetian blind or pleated blind includes a headrail enclosure, preferably of extruded aluminum construction, having integrally spaced headrail hooks and a hook keeper extending from the enclosure edges. A pair of or more universal mounting brackets are alternatively attachable to either a horizontal surface at the top of a window opening or to a vertical wall or vertical top surface of a window frame, dependent upon the type of installation. The brackets thus can be mounted horizontally or vertically on these respective surfaces. The mounting bracket includes a hook extending from each end of a base portion fixed to a window-adjacent surface. One of the hooks of each bracket contains a discrete wave-like leaf spring. After the brackets have been mounted adjacent the window, the headrail is positioned by an installer to have an integral headrail hook guided into the spring-containing bracket hook to compress the spring and allow the other headrail hook or the headrail hook keeper, dependent on whether the brackets are mounted horizontally or vertically, to clear a distal end of the other bracket hook. Upon a slight tilting of the headrail to essentially a horizontal position and the release of the compressed spring, the resultant spring force clamps the first headrail hook to the spring-containing bracket hook and either the other headrail hook or headrail hook keeper to the other bracket hook, again dependent on whether the brackets are mounted horizontally or vertically.

24 Claims, 5 Drawing Sheets

WINDOW BLIND HEADRAIL AND MOUNTING BRACKET

RELATED APPLICATIONS

This application relates to pending application Ser. No. 07/395,036 filed Aug. 17, 1989, R. Yannazzone entitled "Window Blinds", and application Ser. No. 07/493,175 filed Mar. 14, 1990 entitled "Venetian Blind", Schaefer et al. filed herewith, both applications being assigned to the same Assignee as this application.

BACKGROUND OF THE INVENTION

This invention relates to a mounting bracket for a window blind having a headrail. More particularly the invention is directed to a headrail/mounting bracket combination in which a mounting bracket can be mounted either vertically or horizontally adjacent to a window opening, sash or frame, and a horizontal headrail snapped into engagement with the bracket. The headrail may mount Venetian blinds, pleated shades or other vertical blinds.

Headrails of window blinds are normally supported either by side edge brackets (U.S. Pat. No. 2,231,778), corner brackets (U.S. Pat. No. 3,605,852), top brackets with a movable latch pivotable over headrail rolled edges (U.S. Pat. No. 4,753,281), friction clamp (U.S. Pat. No. 3,334,682), a spring hook bracket (U.S. Pat. No. 4,411,401) or a ceiling-mounted hook and shelf support bracket (U.S. Pat. Nos. 4,235,406 and 4,406,435). In the latter two patents the headrail contains an inwardly facing hook at the interior top edge of the headrail which hooks onto a facing bracket hook and wherein an exterior-facing bottom edge of the headrail is slid onto the bracket horizontal shelf which with the hook connection supports the headrail. In the '401 patent a separate adapter is used to mount the bracket on a vertical side wall. It is seen that none of the above mounting brackets are capable of universal mounting. "Universal mounting" as used herein means that the same bracket or brackets can be mounted 1) horizontally on a ceiling mount or on an upper horizontal window frame portion or 2) vertically on a vertical room wall above a window or on an upper vertical window frame portion.

SUMMARY OF THE INVENTION

The universal support bracket of this invention permits the installer, be it a professional installer or a do-it-yourself home dweller, to first mount the support bracket in the most convenient position dictated by the particular window frame, window, ceiling and wall construction to which the overall window blind is to be mounted. Once the support bracket, either one long central bracket or a pair or more of spaced shorter brackets, is mounted by appropriate fasteners to a wall, window frame and/or stud surface by screws or Molybolt or the like, the headrail and its attached window slat structure, i.e. the overall window blind, is easily snapped into horizontal position into either a horizontally or vertically mounted support bracket. Further, the headrail and slat structure is easily removed without tools from the support bracket, if it is necessary to remove the overall window blind for repair, leaning, replacement or room painting or window repair.

The universal mounting capability is provided in the present invention by a mounting bracket having a base portion mountable to a window-adjacent surface by an appropriate mechanical connector or adhesive bonding, a pair of integral spaced bracket hooks extending from end portions of the base portion and a leaf spring confined in one of the hooks. The headrail is in the form of an elongated box-like enclosure having a horizontal bottom. As known in the prior art, window blind slat tilting and slat lowering and raising mechanisms are mounted in the enclosure of the headrail. The headrail of the invention includes a pair of integral spaced headrail hooks extending upwardly from a top, generally open side of the headrail enclosure, and an integral hook keeper extending downwardly from an exterior facing vertical side of the headrail enclosure.

After the mounting brackets have been mounted on a window frame, casement, ceiling or wall surface, the headrail and overall blind is lifted into position adjacent the brackets, the headrail slightly tilted and one of the headrail hooks engaged with and pushed against the spring in one of the bracket hooks to compress the spring. Upon sufficient spring compression, the headrail is rotated slightly from its tilted position back to a horizontal position to allow the other of the headrail hooks or the hook keeper, dependent on horizontal or vertical bracket orientation, to fit into the other headrail hook such that the then outwardly acting spring force of the compressed spring forces the headrail hooks into a clamped position in the bracket hooks in a horizontal bracket mounting mode and forces the spring-contacting hook and the hook keeper into a clamped position in the bracket hooks in a vertical bracket mounting mode.

The above headrail construction allows the headrail to be an extruded one-piece part, made typically of aluminum, dispensing with the prior art rolled metal sheet(s) construction normally employed in headrail manufacture. Further, in both the vertical and horizontal modes of mounting, the brackets are either entirely concealed or essentially entirely concealed from the view of an observer in the room by the front and bottom walls of the headrail.

DETAILED DESCRIPTION

Figure 2:
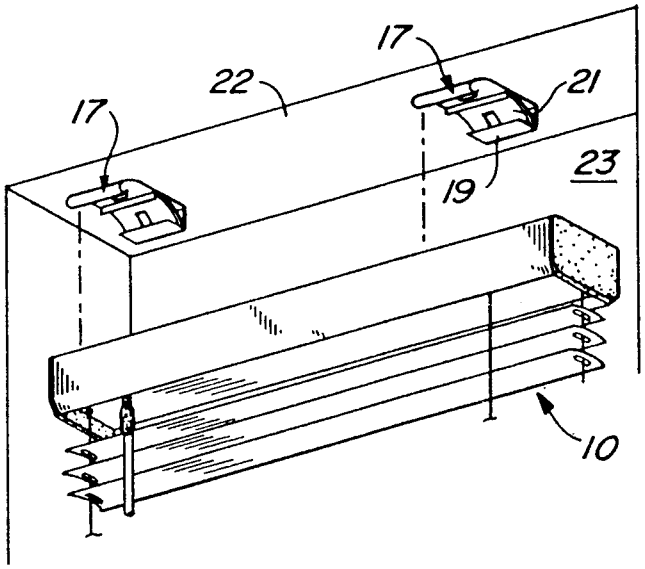
FIG. 2 is a perspective view of horizontally installed mounting brackets and a partial view of a window blind about to be mounted thereon.
Figure 1:
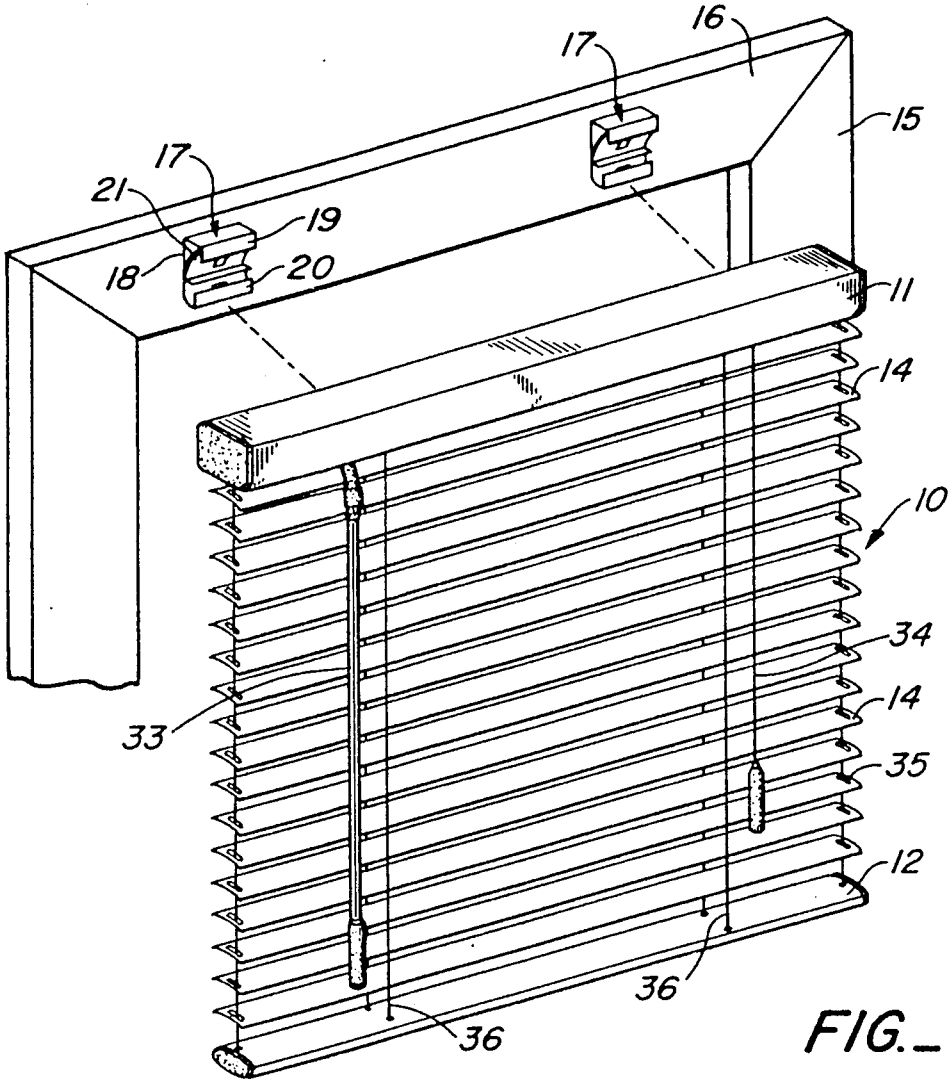
FIG. 1 is a perspective view of vertically installed mounting brackets and a window blind with its headrail about to be mounted thereon.

A preferred embodiment of the invention is seen in FIGS. 1 and 2 in which a window blind 10 of the Venetian-type having a headrail 11, a bottom rail 12 and a series of parallel spaced slats 14 extending therebetween is to be mounted horizontally with respect to a window frame 15 having a horizontal top portion 16. A pair of mounting brackets 17 are spacedly affixed by screw 9, Moly-bolt or adhesive to frame portion 16. It is understood that the window-adjacent surface to which the brackets are affixed may be a vertical wall surface, a window frame portion, or any structural member to which it is desired that the headrail be affixed. Each bracket 17 comprises a flat base portion 18 which abuts the mounting surface, a relatively large integral hook 19, a smaller integral hook 20, each hook extending from an end of the base portion 18, and a leaf-spring 21 slidingly confined in hook 19. In the mounting mode shown, hook 19 is at the top edge of bracket 17. Hook 19 has a longer hook depth than hook 20.

In the FIG. 2 bracket mounting mode the brackets 17 are mounted on a ceiling 22 of a window recess 23 into which the window blind 10 is to be installed. In this horizontal mounting mode the larger spring-containing hook 19 is mounted with the hook opening facing the interior of the room having the window recess 23.

Figure 3:
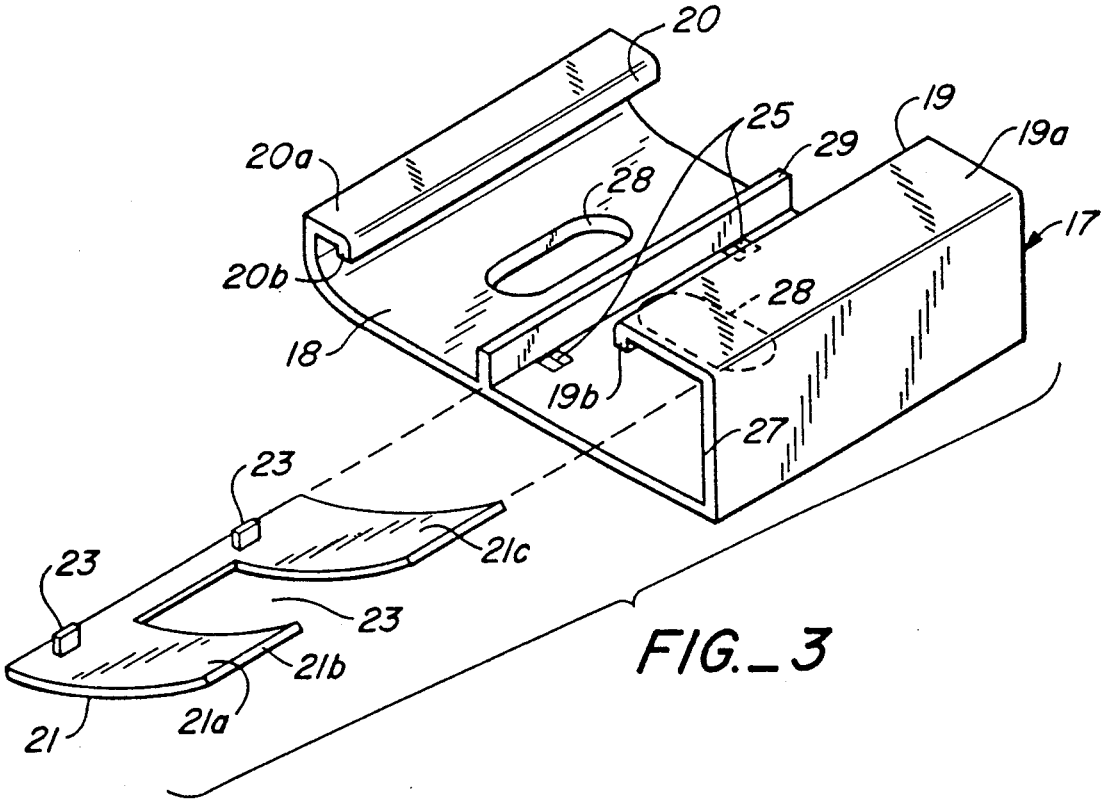
FIG. 3 is a perspective exploded view of the mounting bracket.
Figure 4A:
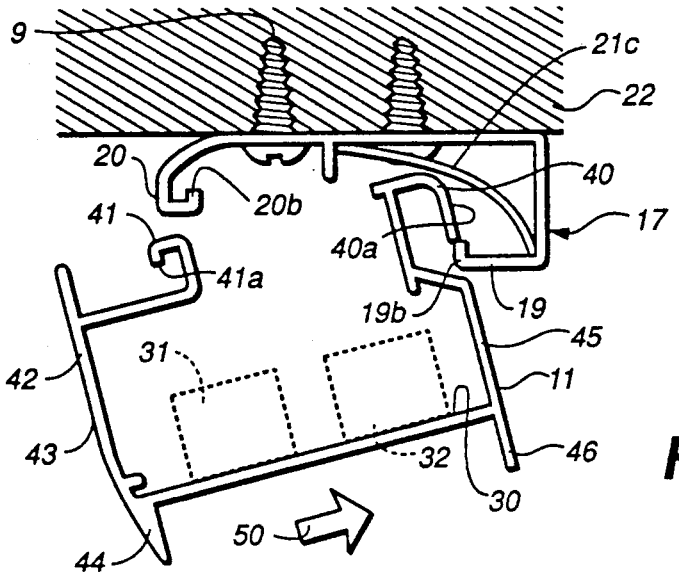
FIG. 4A is a schematic end view of a headrail enclosure in a first installation step poised to start spring compression in a horizontally mounted bracket.

The bracket 17 is seen in detail in FIG. 3. The base portion 18 is apertured with orthogonally spaced slots 28 to receive a screw or other fastener for mounting the bracket to a window-adjacent surface with the underside of the base portion abutting that surface. The smaller hook 20 extends curvilinearly from one end of the base portion forming a distal hook portion **20*b* and a flat intermediate portion 20*a*. The larger hook 19 extends as an angular portion formed by wall 27 orthogonal to the base portion, an intermediate flat portion 19*a* and a distal hook end 19*b*. Spring-holding retention apertures 25 are formed between the inside of wall 27 and a transverse rib 29 extending across the base portion 18 and from an under-surface of opposite flat portion 19*a*. The leaf spring 21 is generally U-shaped with a curved concave pair of legs 21*a* and 21*c* and a pair of retention tabs 23 depending from a base edge which fit into and are staked with respect to the retention holes 25 and which abut rib 29. The distal ends 21*b* of the legs 21*a*, 21*c* in the non-compressed condition extend to the internal junction of flat portion 19*a* and wall 27 of the bracket (FIG. 4A). Access to the slot 28 between rib 29 and wall 27 is through the space 23*a* between the spring legs. When the spring 21 is compressed by an edge of a headrail hook, the legs become more concave and are placed into compression with the cantilevered distal spring ends being slidable on the interior of bracket wall 27. Transverse rib 29 which extends across a medial portion of base portion 18 which as seen in FIG. 5C** also aids in holding the headrail orthogonally to the bracket.

The headrail 11 is seen schematically in end cross-section in the series of FIGS. 4 and 5, which illustrate a three step procedure used in mounting the headrail and its attached slats and bottom rail seen in FIGS. 1 and 2, to the brackets. The headrail is preferably constructed by extruding aluminum into an elongated box-like enclosure having a bottom wall 30 to which is mounted a slat tilt mechanism 31 and slat and bottom rail raising and lowering mechanism 32 as is known in the art. These mechanisms are operated respectively by a tilt rod 33 and a draw cord 34 (FIG. 1) extending from the headrail 11. The draw cord also extends through end apertures 35 in the slats 14 and is affixed interiorly of the bottom rail 12. String-type tilt ladders 36, operable by the tilt wand and tilt mechanism, as well known in the art, complete the blind construction.

Headrail 11 includes an outwardly facing large headrail hook 40 and an inwardly-facing smaller headrail hook 41. "Inward" as used herein refers to the interior of a room containing a window on which the blind is mounted. A headrail front wall 42 may have a distinctive room-facing surface 43. Depending tangs 44 and 46 extend downwardly from headrail hook 41 and aids in blocking light from entering past the headrail. A headrail integral rear wall 45 extends downwardly from hook 40 and terminates in tang 46 which also functions as a hook keeper extending orthogonally from and below enclosure bottom wall 30.

Figure 4B:
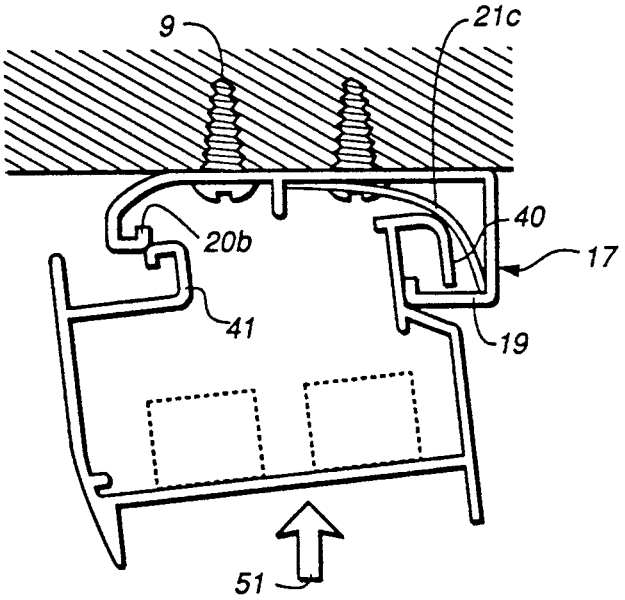
FIG. 4B is a schematic end view of a second installation step showing the leaf spring in compression and a front headrail hook poised to clear a front bracket hook.
Figure 4C:
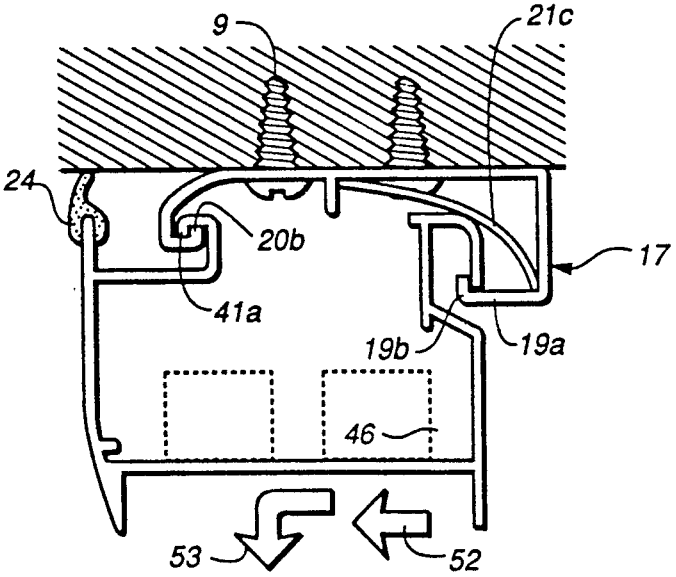
FIG. 4C is a schematic end view of a third and last installation step showing the spring force clamping the headrail hooks in the bracket hooks.

FIGS. 4A, 4B and 4C illustrate the three step assembly of the headrail 11 into the brackets 17. In step 4A the headrail is tilted slightly downward at its room-facing longitudinal edge adjacent tang 44 so that headrail hook 40 clears the distal end **19*b* of bracket hook 19 and the outer surface 40*a* of headrail hook 40 is in position to then contact and compress the spring curvilinear legs 21*a*,21*c* by headrail push movement by the installer indicated by arrow 50. FIG. 4B shows the resultant compression of spring 21 with the legs substantially more concave in bracket hook 19. During this movement the edges 21*b* of the spring are free to slide slightly in the noted hook corner. The headrail hook 40 as seen in FIG. 4B is sufficiently into the bracket hook 19 so that the opposite small headrail hook 41 clears the other bracket hook 20, more particularly its distal end 20*b*, and the headrail pushed upward as seen by arrow 51 to a horizontal non-tilted position. Upon release of the headrail, the spring force exerted by the then expanding leaf spring 20 drives (as seen in FIG. 4C) the distal end of hook 40 into clamping position in the distal end 19*b* of hook 19 and the distal end 41*a* of hook 41 into clamping position in the distal end 20*b* of bracket hook 20. This spring-forced headrail movement is seen by arrows 52 and 53**.

Figure 5A:
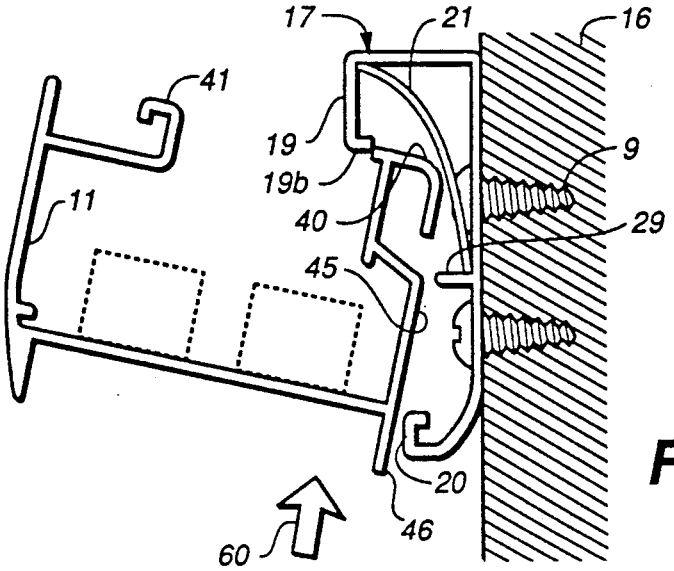
FIG. 5A is a schematic end view of a headrail enclosure in a first installation step poised to start leaf spring compression in a vertically mounted bracket.
Figure 5B:
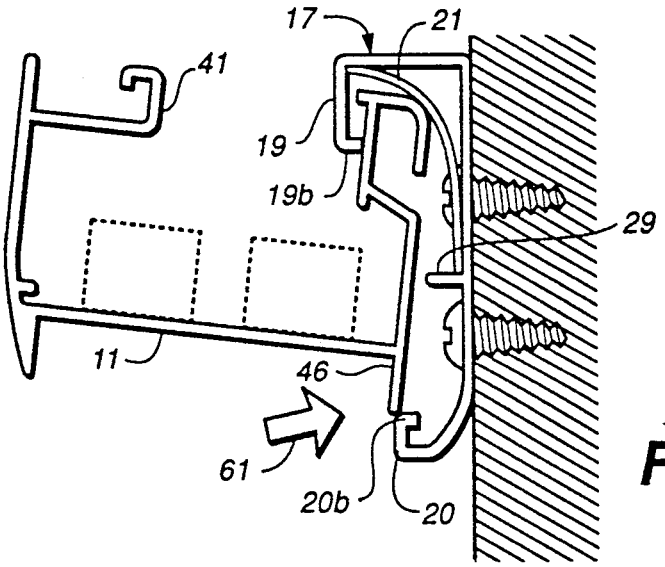
FIG. 5B is a schematic end view of a second installation step showing spring compression and a hook keeper poised to clear a bracket bottom hook.
Figure 5C:
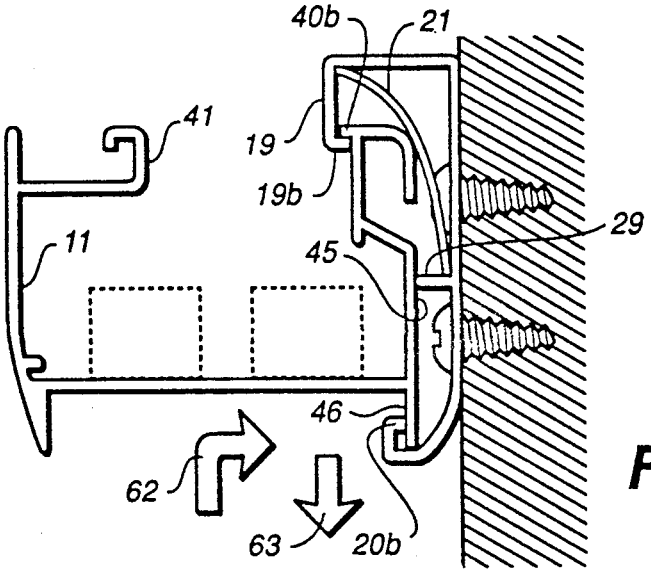
FIG. 5C is a schematic end view of a third and final installation step showing a spring force clamping a headrail hook and headrail hook keeper in the bracket hooks.

FIGS. 5A, 5B and 5C illustrate the installation of headrail 11 into a vertically mounted bracket 17. As seen in FIG. 5A, the headpiece 11 is slightly tilted upwardly at its interior-facing edge so that headrail hook 40 enters bracket hook 19 and is pushed against spring 21 as shown by arrow 60 to compress the spring. After the spring 21 has been sufficiently compressed as shown in FIG. 5B, the headrail hook keeper or tang 46 is able to clear the distal end **20*b* of bracket hook 20. The headrail is brought to an essentially horizontal position as indicated by arrow 62 in FIG. 5C and upon release of the headrail the expanding spring pressure of spring 21 as seen by arrow 63 forces a tip 40*b* of headrail hook 40 into clamped relation with the distal end 19*b* of bracket hook 19 and the headrail hook keeper 46 into clamped contact with the distal end 20***b* of bracket hook 20. The rear wall 45 of the headrail enclosure abuts the distal edge of bracket rib 29 so that the headrail is held in a cantilevered horizontal position extending from a pair of brackets. In this mounting mode the headrail hook 41 does not function as a holding member.

Figure 6:
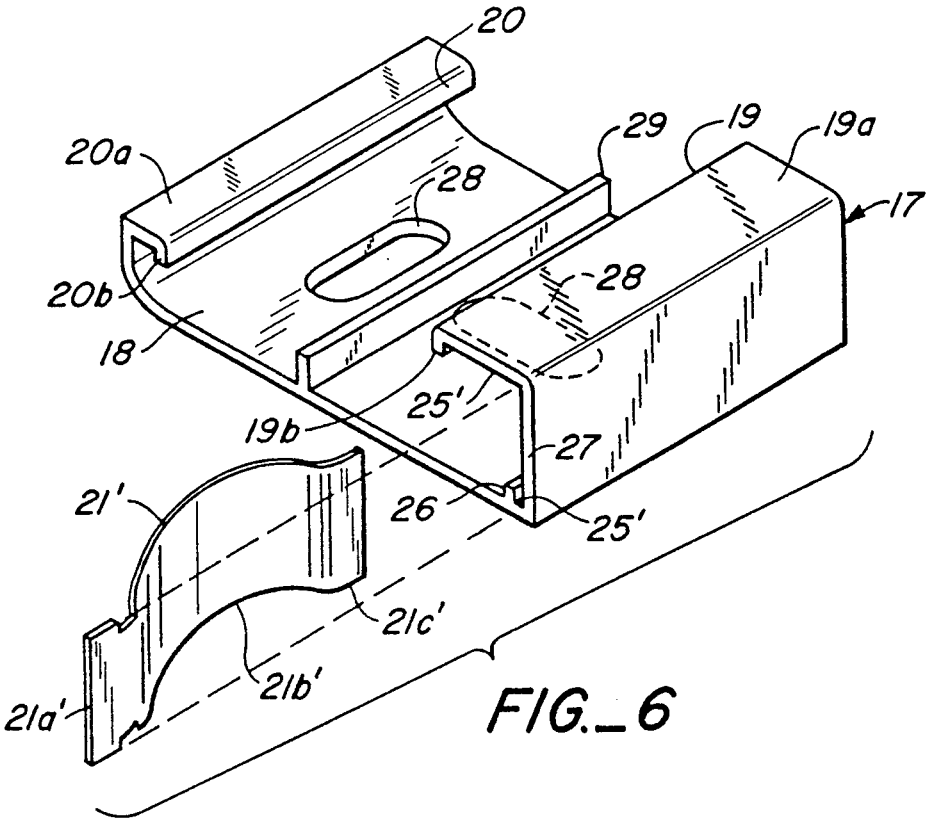
FIG. 6 is a perspective exploded view of a second embodiment of the mounting bracket utilizing a wave spring.
Figure 7:
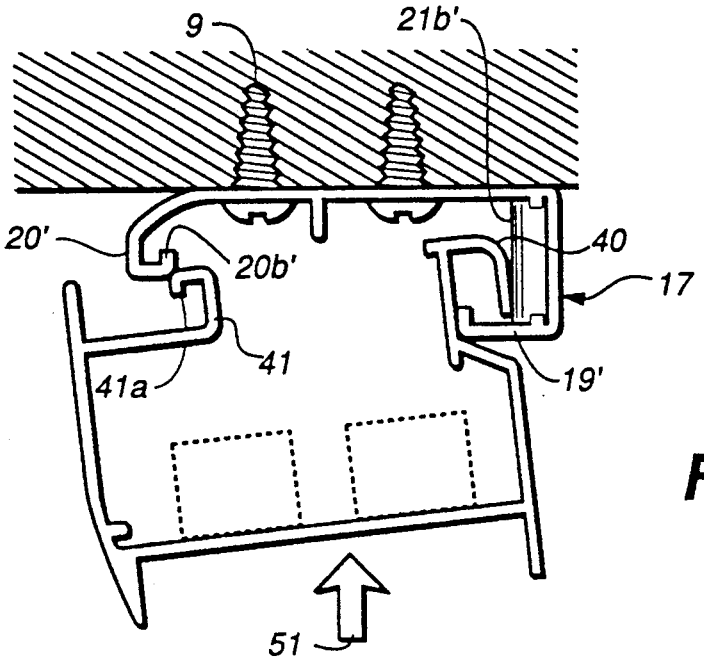
FIG. 7 is a schematic end view showing an intermediate installation step where the wave spring is in compression and the bracket is mounted horizontally.

FIG. 6 illustrates another embodiment of the bracket which utilizes a wave-like spring 21' having ends 21*a'* and 21*c'* which are slidable in upper and lower slots 25' formed by ribs 26 extending interiorly from hook portion 19*a'* and the base portion 18'. The spring 21' contains an intermediate hump-like portion 21*b'* which extends outwardly from wall 27. As seen in FIG. 7, which illustrates a step similar to the step illustrated in FIG. 4B, the spring hump-like portion is pushed inwardly into compression by inward tilted movement of headrail hook 40. When the hook 41 clears the distal end 21*b'* of the bracket, the spring 21' expands hooking and locking the large headrail hook 40 into bracket hook distal end 19*b'* and headrail hook 41 into hook 20'.

Figure 8:
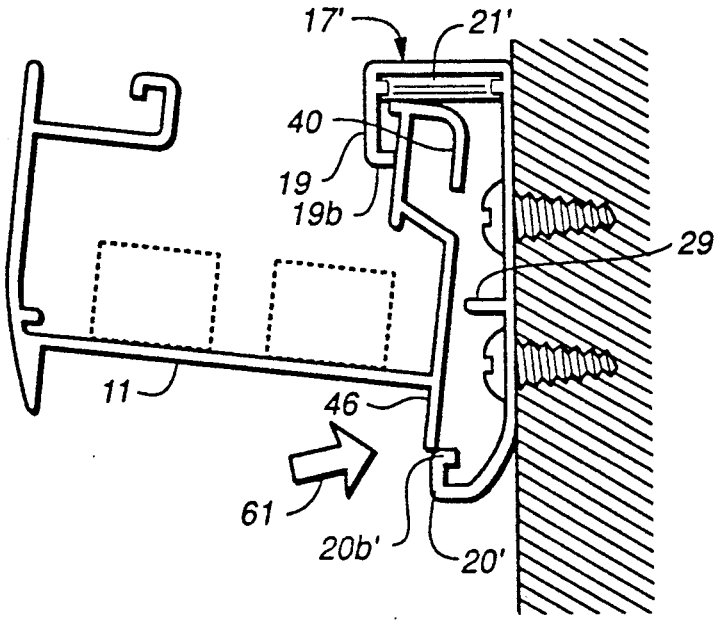
FIG. 8 is a schematic end view showing an intermediate installation step where the wave spring is in compression and the bracket is mounted vertically.

FIG. 8 illustrates a vertically mounted bracket with the hook 40 compressing spring 21' similar to the FIG. 5B step. Upon pivoting of the headrail, as seen by arrow 61, the hook keeper 46 clears hook distal end 20*b'* and upon the release of spring compression forces the hook 40 into engagement with hook distal end 19*b'* and keeper/tang 46 into locked engagement with hook 20'.

While the invention has been illustrated and described utilizing a pair of spaced mounting brackets, it is contemplated that, depending on the length of the blind, more than two support brackets may be utilized; it is also contemplated that a single bracket of greater lateral width mounted at the center top of a window opening may be utilized with one or more springs confined in a bracket hook for spring connection to a hook(s) or keeper of an extruded headrail, as described above.

The above description of embodiments of this invention is intended to be illustrative and not limiting. Other embodiments of this invention will be obvious to those skilled in the art in view of the above disclosure.

We claim:

1. In combination, a window blind headrail and at least one mounting bracket therefor; said at least one bracket being universally mountable in a horizontal mounting mode on a horizontal fixed window-adjacent surface or in a vertical mounting mode on a vertical fixed window-adjacent surface and said headrail being mountable horizontally in said at least one bracket in either mounted position of said bracket; wherein said at least one bracket comprises:

a base portion mountable to a window-adjacent surface;

a pair of integral spaced bracket hooks extending from end portions of said base portion; and spring means in one of said bracket hooks for holding said headrail; and wherein said headrail comprises:

an elongated box-like enclosure for placement of window blind slat tilting and lowering/raising mechanisms;

a pair of integral spaced headrail hooks extending from a first side of said enclosure; and a hook keeper extending from a second side of said enclosure orthogonal to said first side, one of said pair of headrail hooks being engageable with said spring means in said one bracket hook to compress said spring means to allow the other of said headrail hooks or said hook keeper to fit into the other of said pair of bracket hooks such that a spring force of said spring means forces said headrail hooks into a held position in said bracket hooks in said horizontal bracket mounting mode and such that said spring force forces said one of said headrail hooks and said hook keeper into a held position in said bracket hooks in said vertical mounting mode.

2. The combination of claim 1 in which said spring means is a leaf spring insertable into and held a channel in said said one bracket hook.

3. The combination of claim 2 in which said pair of bracket hooks have hook openings which face one another.

4. The combination of claim 3 in which said pair of headrail hooks have hook openings which face in opposite directions.

5. The combination of claim 1 in which said spring means-containing bracket hook has a larger hook depth than a hook depth of said other bracket hook.

6. The combination of claim 1 in which said pair of headrail hooks extend from a top surface of said headrail enclosure and said hook keeper is a linear distal extension of a rear vertical wall of said headrail enclosure.

7. The combination of claim 1 in which said pair of bracket hooks have hook openings which face one another.

8. The combination of claim 1 in which said pair of headrail hooks have hook openings which face in opposite directions.

9. A bracket for mounting a window blind headrail, said bracket comprising:

an elongated base;

means in said base for forming an aperture for reception of a fastener to attach said bracket to a fixed surface;

a bracket end extending orthogonally from one end of said base;

a first hook having an open portion extending inwardly from a distal end of said bracket end;

a discrete non-integral compressible spring abutting said bracket end and being confined between said bracket end and said base and within said first hook; and a second hook extending from another end of said base and having an open portion facing said first hook open portion.

10. The bracket of claim 9 in which said spring is U-shaped having a base staked to said bracket base and a pair of legs extending into said first hook.

11. The bracket of claim 9 further including an orthogonal rib extending from said base parallel to said bracket end and intermediate of said hooks, said rib being positioned to abut a rear wall of a headrail mounted on vertically oriented bracket base.

12. A bracket for mounting a window blind headrail, said bracket comprising:

an elongated base;

means in said base for forming an aperture for reception of a fastener to attach said bracket to a fixed surface;

a bracket end extending orthogonally from one end of said base;

a first hook extending inwardly from a distal end of said bracket end;

a discrete compressible spring abutting said bracket end and being confined between said bracket end and said base and said first hook;

a second hook extending from another end of said base and facing said first hook; and in which said bracket end includes means for forming a pair of slots extending parallel to said bracket end, said spring having a flat wave form with a first end slideably captured by said slots, a second end slideably captured by said slots and an intermediate portion extending outwardly from said slots and facing toward said second hook, said intermediate portion being flexibly compressible inwardly toward said bracket end and said spring ends being slideable in said slots during mounting of a headrail in said bracket and wherein said intermediate portion exerts a spring force on a headrail portion to fixedly hold said headrail between said first and second bracket hooks.

13. A bracket for mounting a window blind headrail, said bracket comprising:

an elongated base;

means in said base for forming an aperture for reception of a fastener to attach said bracket to a fixed surface;

a bracket end extending orthogonally from one end of said base;

a first hook extending inwardly from a distal end of said bracket end;

a discrete compressible spring abutting said bracket end and being confined between said bracket end and said base and said first hook;

a second hook extending from another end of said base and facing said first hook, further including an orthogonal rib extending from said base parallel to said bracket end and intermediate of said hooks, said rib being positioned to abut a rear wall of a headrail mounted on vertically oriented bracket base; and wherein one end of said spring abuts said rib.

14. A window blind headrail bracket comprising:

an elongated base having an intermediate portion including a mounting aperture for mounting said bracket horizontally or vertically;

a pair of bracket hooks integrally formed with and extending from an end of said base for mounting a window blind headrail therebetween, said pair of hooks facing each other; and a discrete non-integral spring in one of said hooks for pushingly positioning portions of a headrail into a fixed secured position between said hooks.

15. The bracket of claim 14 in which said spring is a leaf spring insertable into and held by a channel in said one bracket hook.

16. The bracket of claim 14 in which said one spring-containing bracket hook has a larger hook depth than a hook depth of said other bracket hook.

17. The bracket of claim 14 wherein said spring is of a wave form and includes ends positioned in said spring-containing hook and an intermediate spring portion facing the other hook, said spring portion being compressible while mounting a headrail and exerting a spring force on a mounted headrail positioned between and fixedly held in said hooks.

18. In combination, a window blind headrail and at least one mounting bracket therefore; said at least one bracket being universally mountable in a horizontal operational mode on a horizontal fixed window frame surface or in a vertical operational mode on a vertical fixed window frame surface and said headrail being mountable horizontally in said at least one bracket in either mounted position of said at least one bracket; wherein said at least one bracket comprises:

a one-piece essentially flat base portion mountable to either a window frame horizontal or vertical surface; and a pair of bracket hooks each having an open portions facing each other and extending at spaced positions from each end of said base portion, a discrete spring in one of said bracket hooks for removably mounting said headrail in said bracket; and wherein said headrail comprises an elongated box-like enclosure for placement of window blind slat tilting and lowering/raising mechanisms;

first means extending from an upper rear corner of said enclosure for entry and locking into one of said bracket hooks for removably mounting said enclosure; and second means extending from an adjacent corner of said enclosure for entry and locking into the other of said bracket hooks for removably mounting said enclosure; and wherein said enclosure in either of said operational modes of mounting said bracket effectively conceals said bracket from view from a front lower corner of said enclosure.

19. The combination of claim 18 in which said spring is compressible for allowing entry of said first means into said bracket and having a resultant spring force locking said first means into said bracket.

20. The combination of claim 18 wherein said second means comprising an integral hook extending substantially from an upper front corner of said enclosure and lockable into the other of said bracket hooks for mounting in a bracket horizontal operational mode.

21. The combination of claim 18 wherein said second means comprises an integral straight tang extending from a lower rear corner of said enclosure and lockable into the other of said bracket hooks for mounting in a bracket vertical operational mode.

22. In combination, a window blind headrail and at least one mounting bracket therefor; said at least one bracket having a common surface and mounting aperture universally mountable in a horizontal operational mode on a fixed horizontal window-adjacent surface or in a vertical operational mode on a fixed vertical window-adjacent surface and said headrail being mounted horizontally in said at least one bracket in either mounted position of said at least one bracket; wherein said at least one bracket comprises:

a base portion mountable on a window-adjacent surface and first and second locking means extending from said base portion and facing each other for removably mounting and holding said headrail in said bracket; and wherein said headrail comprises an elongated box-like extruded channel having a first integral means on one corner thereof for entry and locking into one of said bracket locking means and second integral means on an adjacent corner of said extruded channel for entry and locking into the other of said bracket locking means.

23. The combination of claim 22 in which one of said bracket locking means includes a discrete spring, said spring being compressible for allowing entry of said first integral means into said bracket locking means and having a resultant spring force locking said channel first integral means and said channel second integral means into said first and second locking means, respectively, of said bracket.

24. The combination of claim 23 wherein said first and second locking means and said channel first and second integral means each include hook means for locking said headrail in said bracket.

* * * * *

UNITED STATES PATENT AND TRADEMARK OFFICE

CERTIFICATE OF CORRECTION

PATENT NO. : 5,042,553

DATED : August 27, 1991

INVENTOR(S) : John F. SCHAEFER, et al.

It is certified that error appears in the above-identified patent and that said Letters Patent is hereby corrected as shown below:

On the title page, under item (19), change "Schaffer" to to --Schaefer--.

On the title page, under item (75) Inventors: change "John F. Schaffer" to --John F. Schaefer--

Signed and Sealed this

Second Day of March, 1993

*Attest:*

STEPHEN G. KUNIN

*Attesting Officer*

*Acting Commissioner of Patents and Trademarks*